United States Patent [19]

Krips et al.

[11] 4,055,063

[45] Oct. 25, 1977

[54] APPARATUS FOR THE EXPANSION OF TUBE ENDS INSIDE OF A TUBE PLATE

[75] Inventors: Herbert Krips, Bochum-Langendreer; Miroslav Podhorsky, Bochum, both of Germany

[73] Assignee: Balcke-Dürr Aktiengesellschaft, Ratingen, Germany

[21] Appl. No.: 777,099

[22] Filed: Mar. 14, 1977

[30] Foreign Application Priority Data

Apr. 14, 1976 Germany ..... 2616523

[51] Int. Cl.[2] ..... B21D 22/10; F15B 7/00

[52] U.S. Cl. ..... 72/62; 60/560; 72/453.01

[58] Field of Search ..... 72/61, 62, 453.01, 453.02, 72/DIG. 5; 60/560, 325, 486; 100/269 B

[56] References Cited

U.S. PATENT DOCUMENTS

| | | | |
|---|---|---|---|
| 2,481,991 | 7/1949 | Ernst | 60/560 X |
| 2,827,766 | 3/1958 | Hufford | 60/560 |
| 3,623,320 | 11/1971 | Moore | 60/486 |
| 3,977,068 | 8/1976 | Krips | 72/62 X |

FOREIGN PATENT DOCUMENTS

| | | | |
|---|---|---|---|
| 1,405,974 | 9/1975 | United Kingdom | 72/453.01 |

*Primary Examiner*—Leon Gilden
*Attorney, Agent, or Firm*—Martin A. Farber

[57] ABSTRACT

An apparatus for the expansion of tube ends inside of a tube plate by means of a probe insertable in the respective tube ends, the probe forming an annular space with the tube member to be widened by means of two seals spaced from one another, a pump operatively feeding the annular space with a pressure medium for the expansion, and a pressure intensifier for bringing the pressure medium to a required pressure. A medium separator is connected via a back-pressure valve to a secondary-sided space of a primary-sided hydraulic oil driven pressure intensifier. A piston displaceably disposed in the medium separator is biased by a return spring in the medium separator, and the pump feeds the hydraulic oil displacing the piston against the restoring force of the return spring for the filling of the secondary space of the pressure intensifier with an operating medium. The operating medium flows from an operating medium-supply container and another back-pressure valve to the secondary side of the medium separator.

4 Claims, 2 Drawing Figures

APPARATUS FOR THE EXPANSION OF TUBE ENDS INSIDE OF A TUBE PLATE

Figure 1:
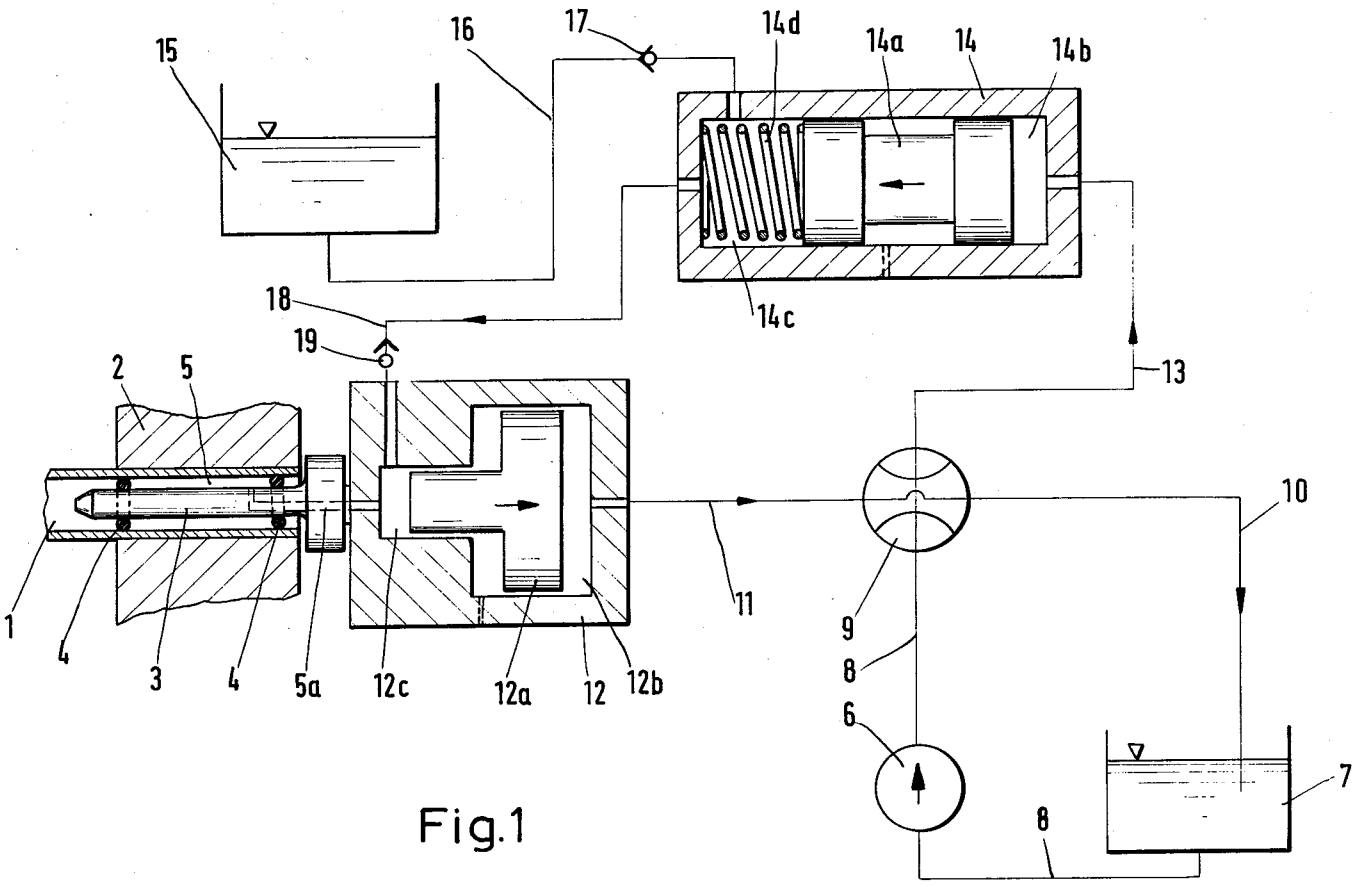

The invention relates to an apparatus for the expansion swaging of tube ends inside of a tube plate by means of a probe insertable in the respective tube end, which probe forms an annular space with the member which is to be expanded by means of two seals located spaced from one another, the annular space being filled with a pressure medium for the expansion, which pressure medium is fed by means of a pump and is brought to the required pressure by a pressure intensifier.

Devices of the previously-described type are known. They serve particularly for the pressure-tight securing of tubes to a tube plate, preferably with the production of heat exchangers.

The liquid to be used as the pressure medium is set by the pressure producing unit with the known devices. Preferably as a pressure medium, a water-soluble hydraulic oil is used which is proper for the requirements and demands of the pressure producer as well as the pressure intensifier.

With the known devices, since the pressure medium comes directly in contact with the tube member to be expanded, after the expansion an extensive cleaning of the tubes and of the tube plates are required, when the produced apparatus relates to a high-quality unit, which must be absolutely clean before the time of beginning of operation, as this is the case for example with nuclear power systems. In spite of the use of a water-soluble oil, there results in this manner a time- and cost- expense, which can be as high as that for the actual expansion process.

It is an object of the present invention to produce a device of the introductory mentioned type which prevents a soiling of the tube ends to be expanded and the tube plates by the hydraulic oil which is used for the expansion process.

It is another object of the present invention to aid in the solution of the above-mentioned object by connecting a medium separator 14 via a relief or back-pressure valve 19 to the secondary space 12*c* of the pressure intensifier 12, the latter being driven on its primary side by hydraulic oil, the medium separator having a piston 14*a* which is displaceable by means of a hydraulic oil feed pump 6 against a restoring force (return spring 14*d*) for filling the secondary space 12*c* of the pressure intensifier 12 with an operating medium, the operating medium flowing from an operating medium-supply container 15 via a further back-pressure valve 17 to the secondary side 14*c* of the medium separator.

With this proposal in accordance with the present invention, a device is provided, the pressure producing parts of which are driven as previously with hydraulic oil, by which however the tube ends to be expanded come in contact with an operating medium which exclusively can be freely selected with consideration of the requirements of the unit to be manufactured. As an operating medium, water, for example, can be used, which can be provided with suitable additives for the prevention of corrosion. The device in accordance with the present invention thus prevents a soiling of the tubes to be widened with hydraulic oil so that the previously mentioned time- and cost- expenditures for the cleaning of the tubes and the tube plates can be avoided.

According to a further feature of the invention, in the conduits between the pump or hydraulic oil container on the one hand and the pressure intensifier and medium separator on the other hand, a multi-path-distributor valve is inserted, which connects either the pump with the pressure intensifier and the medium separator with the hydraulic oil container or the pump with the medium separator and the pressure intensifier with the hydraulic oil container.

By these further developments in accordance with the present invention an exiting of hydraulic oil is avoided, whereby not only are hydraulic oil losses through the closed circuit of the hydraulic oil excluded, but also any soiling by hydraulic oil is prevented. The control of the device takes place in a simple manner by actuation of the multi-path distributor valve. Also a loss of the operating medium is limited to a minimum since an out-flow of the operating medium from the operating medium supply container is prevented by the use of the two pressure-relief valves.

With simple means to attain a good sealing-off inside of the medium separator, it is further proposed in accordance with the present invention to form the piston of the medium separator as a double piston.

Figure 2:
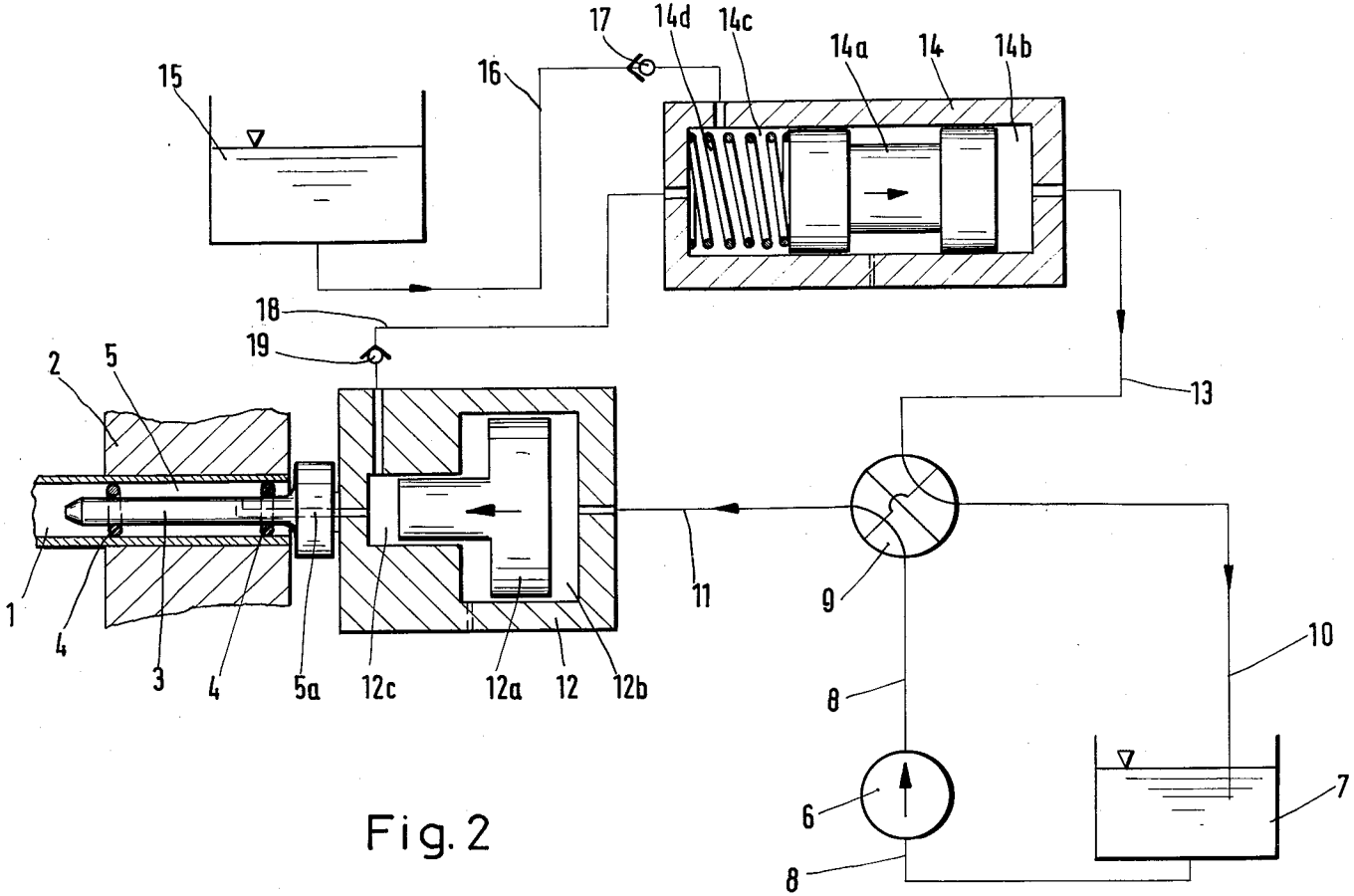

With the above and other objects and advantages in view, the present invention will become more clearly understood from the following detailed description of a preferred embodiment thereof when considered in connection with the accompanying drawings, of which:

FIG. 1 is a schematic illustration partly in longitudinal section of a device during the filling of the tube member to be expanded with operating medium; and FIG. 2 is a similar view of the device according to FIG. 1 during the expansion process.

Referring now to the drawings, the device illustrated in FIGS. 1 and 2 serve for the expansion-swaging of a tube end 1 inside of a tube plate 2 by means of a probe or core 3. This probe 3 is inserted into the tube end 1. It has two seals 4 which lie spaced from one another and which together with the probe 3 and the tube end 1 to be widened form a closed-off annular space 5 in which a pressure medium is introduced via a connection bore 5*a* for producing the expansion swaging operation.

The pressure for this pressure medium is produced by a pump 6 which sucks in hydraulic oil from a hydraulic oil container 7 and feeds to a multi-path distributor valve 9 through a conduit 8. This multi-path distributor valve 9 is connected through a return conduit 10 for the return of the hydraulic oil.

By means of a connection conduit 11, the multi-path distributor valve 9 stands in connection with a pressure intensifier 12, the latter being provided with a stepped piston 12*a*. The larger piston surface of the pressure intensifier 12 is disposed in a primary space 12*b*, and the smaller piston surface is disposed in a secondary space 12*c*.

A fourth connection of the multi-path distributor valve 9 stands in connection with a medium separator 14 via a connection conduit 13, which medium spearator has a piston 14*a* formed as a double piston. By means of this piston 14*a*, a primary side 14*b* and a secondary side 14*c* are produced in the medium separator 14. On the secondary side, the piston 14*a* is provided with a return spring 14*d*.

An operating medium of any choice, for example water, is contained in an operating medium — supply or storage container 15. The operating medium can flow to the secondary side 14*c* of the medium separator 14 through a feed line 16 in which a back-pressure valve 17 is disposed. The secondary side 14*c* of the medium separator 14 stands further in communication with the secondary space 12*c* of the pressure intensifier 12 via a pressurized line 18 in which a back-pressure or check valve 19 is also associated with this pressurized line 18.

The expansion swaging of the tube end 1 takes place as follows:

After the insertion of the probe 3 in the tube end 1 lying inside of the tube plate 2, the multi-path distributor valve 9 is turned into the position illustrated in FIG. 1. In this position it connects the conduit 8 with the connection conduit 13 and the return conduit 10 with the connection conduit 11. During the placing of the pump 6 into operation as a result of this position of the multi-path distributor valve 9, hydraulic oil is fed to the primary side of the medium separator 14, whereby the piston 14*a* is displaced against the force of the return spring 14*d* in the direction of the arrow illustrated in FIG. 1. In this manner with a closed back-pressure valve 17, the operating medium is forced through the pressurized line 18 from the secondary side 14*c* of the medium separator 14 into the secondary space 12*c* of the pressure intensifier 12, and indeed with simultaneous opening of the back-pressure valve 19.

This operating medium flows over the connection bore 5*a* into the annular space 5. By adjusting or balancing the volume of the secondary side 14*c* of the medium separator 14 with the volume of the secondary space 12*c* of the pressure intensifier 12 and with the volume of the annular space 5, it is guaranteed that the annular space 5 is completely filled. By the filling of the secondary space 12*c* with the operating medium standing under pressure, simultaneously the stepped piston 12*a* is displaced in the direction of the arrow illustrated in FIG. 1 so that hydraulic oil which is present in the primary space 12*b* of the pressure intensifier 12 can be fed back into the hydraulic container 7 via the connection conduit 11 and the return conduit 10.

After the filling of the annular space 5 with the operating medium, the multi-path distributor valve 9 is turned into the position illustrated in FIG. 2, in which it connects the line 8 with the connection conduit 11 and the return conduit 10 with the connection conduit 13. The pump 6 thus feeds hydraulic oil into the primary space 12*b* of the pressure intensifier 12 via the conduit 8 and the connection conduit 11. Through the primary-sided outer surface of the stepped piston 12*a,* the pressure which is produced by the pump 6 causes a displacement of the stepped piston 12*a* in the direction of the arrow illustrated in FIG. 2. In this manner in the secondary space 12*c* of the pressure intensifier a higher pressure is produced, which on the one hand securely closes the back-pressure valve 19 and on the other hand propagates into the annular space 5 where it brings about the desired expansion swaging operation.

Since the connection conduit 13 is connected with the hydraulic oil container 7 by the positioning illustrated in FIG. 2 of the multi-path distributor valve 9 via the return conduit 10, which container 7 merely stands under atmospheric pressure, by switching or reversing of the multi-path distributor valve 9 from the position illustrated in FIG. 1 into the position illustrated in FIG. 2, the return spring 14*d* of the medium separator 14 displaces the piston 14*a* in the direction of the arrow illustrated in FIG. 2. In this manner not only is hydraulic oil fed back from the primary side 14*b* of the medium separator 14 into the hydraulic oil container 7 but also simultaneously the operating medium is sucked from the operating medium — supply container 15 through the feed line 16, since the back-pressure valve 17 in the feed line 16 is automatically opened with the movement of the piston 14*a,* which movement is indicated in FIG. 2.

As soon as the expansion operation is completed, the multi-path distributor valve 9 is brought from the position illustrated in FIG. 2 again into the position according to FIG. 1. In this manner the primary space 12*a* of the pressure intensifier 12 is connected with the hydraulic oil container 7 so that the pressure which prevails in the secondary space 12*c* displaces the stepped piston 12*a* whereby the annular space 5 is relieved of pressure. The probe 3 can thus be withdrawn from the tube end 1 and be inserted into another tube end. The apparatus is consequently ready for a new expansion swaging process.

We claim:

1. An apparatus for the expansion of tube ends inside of a tube plate by means of a probe insertable in the respective tube ends, the probe forming an annular space with the tube member to be widened by means of two seals spaced from one another, a pump operatively feeding the annular space with a pressure medium for the expansion, and a pressure intensifier for bringing the pressure medium to a required pressure, comprising a pressure intensifier defining a primary space driven by hydraulic oil and defining a secondary space, a medium separator connected to the secondary space of said pressure intensifier, a back-pressure valve operatively disposed between said medium separator and said secondary space of said pressure intensifier, a piston displaceably disposed in said medium separator, means for providing a restoring force for biasing said piston in said medium separator, a pump means for feeding hydraulic oil displacing said piston against said restoring force of said biasing means for filling said secondary space of said pressure intensifier with an operating medium, a source of operating medium and another back-pressure valve operatively connected to a secondary side of said medium separator, through which the operating medium is operatively fed to said secondary side of said medium separator.

2. The apparatus according to claim 1, further comprising a hydraulic oil container having an inlet and an outlet, a plurality of conduits respectively connected to the primary space of said pressure intensifier, to a primary side of said medium separator, to said inlet of said hydraulic oil container, and to said outlet of said hydraulic oil container, respectively, a multi-path distributor valve means operatively disposed in said plurality of conduits between said pump means and said hydraulic container, respectively, on the one hand and said pressure intensifier and said medium separator, respectively, on the other hand, for operatively connecting either said pump means with said pressure intensifier and said medium separator with said hydraulic oil container or said pump means with said medium separator and said pressure intensifier with said hydraulic oil container, selectively.

3. The apparatus according to claim 1, wherein said piston in said medium separator is formed as a double piston defining said secondary side on one end of said double piston and a primary side on the other end of said double piston, said primary side selectively operatively communicates with said pump means.

4. The apparatus according to claim 1, wherein said biasing means constitutes a return spring disposed against one end of said piston in said medium separator.

* * * * *